United States Patent [19]

Mitchell

[11] 4,110,063

[45] Aug. 29, 1978

[54] GAS FIRE

[76] Inventor: Douglas Allison Mitchell, 7, Clifton Gardens, Eaglescliffe, Stockton-on-Tees, Cleveland, United Kingdom, TS16 9BB

[21] Appl. No.: 701,607

[22] Filed: Jul. 1, 1976

[30] Foreign Application Priority Data

Jul. 3, 1975 [GB] United Kingdom ..... 28021/75

[51] Int. Cl.[2] ..... F24L 3/04

[52] U.S. Cl. ..... 431/125; 431/328

[58] Field of Search ..... 431/326, 327, 328, 329, 431/170, 7, 125; 239/424, 592; 126/92 R

[56] References Cited

U.S. PATENT DOCUMENTS

| | | | |
|---|---|---|---|
| 1,852,290 | 4/1932 | Cocklin | 431/328 |
| 2,086,639 | 7/1937 | Rees | 431/328 |
| 3,003,548 | 10/1961 | Sanders et al. | 239/424 |
| 3,671,175 | 6/1972 | Campbell | 431/328 |
| 3,921,590 | 11/1975 | Mitchell et al. | 110/28 J |
| 3,947,229 | 3/1976 | Richter | 431/328 |

FOREIGN PATENT DOCUMENTS

| | | | |
|---|---|---|---|
| 47,488 | 11/1920 | Denmark | 158/99 |
| 28,477 of | 1912 | United Kingdom | 431/328 |

*Primary Examiner*—Edward G. Favors
*Attorney, Agent, or Firm*—Brisebois & Kruger

[57] ABSTRACT

A heating appliance operated from a gaseous fuel comprises a plurality of refractory bodies simulating solid fuel mounted on the top of a distributor for the gaseous fuel. To ensure that at least some of the gaseous fuel burns at a high temperature thereby causing the simulated solid fuel to be heated and to "glow" at least one duct leads to the upper side of the gas distributor so that air can be passed along the duct to mix with the gaseous fuel.

5 Claims, 5 Drawing Figures

GAS FIRE

This invention relates to heating appliances operable by a gaseous fuel and in particular to gas operable heating appliances which simulate a solid fuel fire.

It is known for a gas operable heating appliance to have refractory bodies which are fashioned and coloured to resemble wood logs. In use, gaseous fuel is distributed to the base of the refractory bodies and when the gas is ignited the flames pass between the "logs" and the appliance has the appearance of a log fire. The flames are not aerated and are therefore luminous in character. Although such flames are suitable for simulating the effect of a log fire, if it is desired to simulate the effect of a glowing solid fuel fire then such flames do not appear particularly realistic.

According to the present invention a heating appliance comprises a plurality of refractory bodies simulating solid fuel mounted on the upper side of a distributor for gaseous fuel and at least one air duct leading to the upper side of the distributor.

The gas fuel (namely town gas, natural or liquefied petroleum gas such as propane or butane) is fed into the distributor and is distributed around the base of the plurality of the refractory bodies. When the gas is ignited some of it burns with a luminous flame but air supplied to the upper side of the distributor through the or each air duct causes some of the gas to burn with a higher temperature flame and for the refractory bodies to be heated to a higher temperature so that they glow and this gives the impression of a brightly burning fire.

The distributor may comprise a bed of particulate refractory material, an apertured tube embedded in the bed and means for supplying gaseous fuel to said tube.

The or each duct conveniently comprises a tube extending through the bed of particulate material to the surface thereof and the or each tube may have an enlarged outlet at its upper end adjacent the surface and furthermore it may have means for adjusting the flow of air therethrough.

In an alternative embodiment of the invention the distributor comprises two separate horizontally spaced apart beds of particulate refractory material, an apertured tube embedded in said beds and means for supplying gaseous fuel to said tube, and the air duct comprises a space between the said beds.

Figure 1:
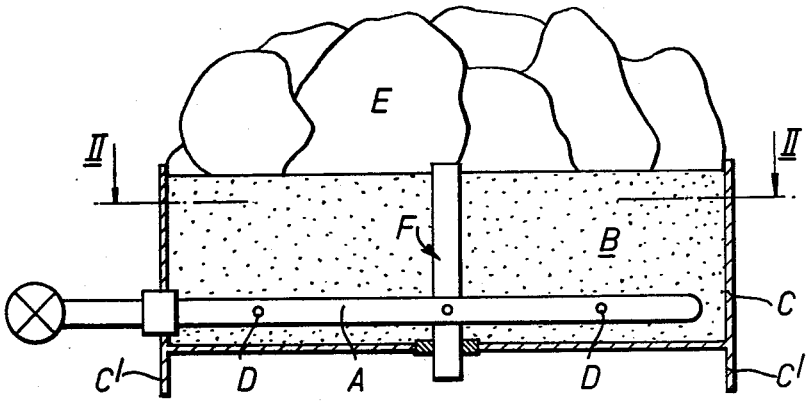
Figure 2:
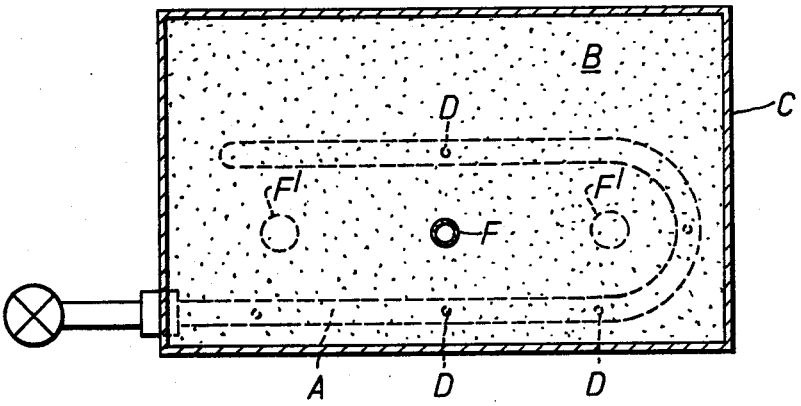
Figure 3:
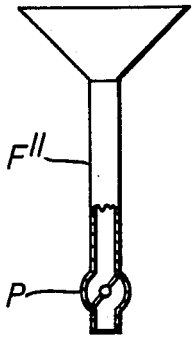
Figure 4:
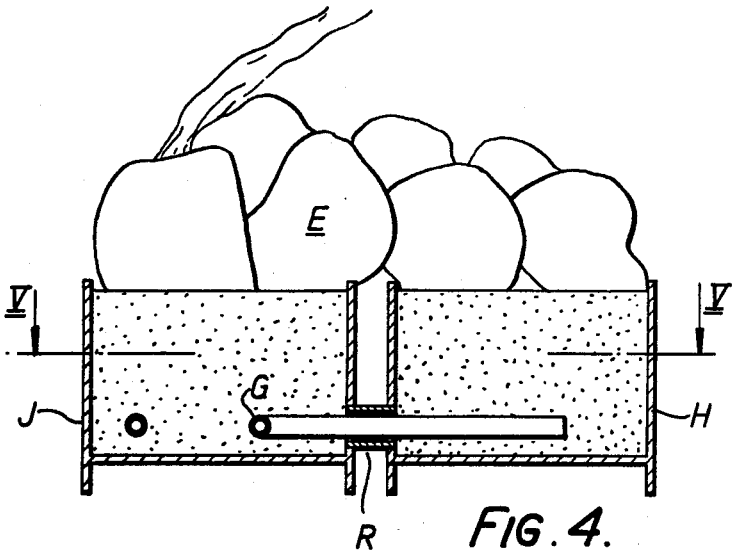
Figure 5:
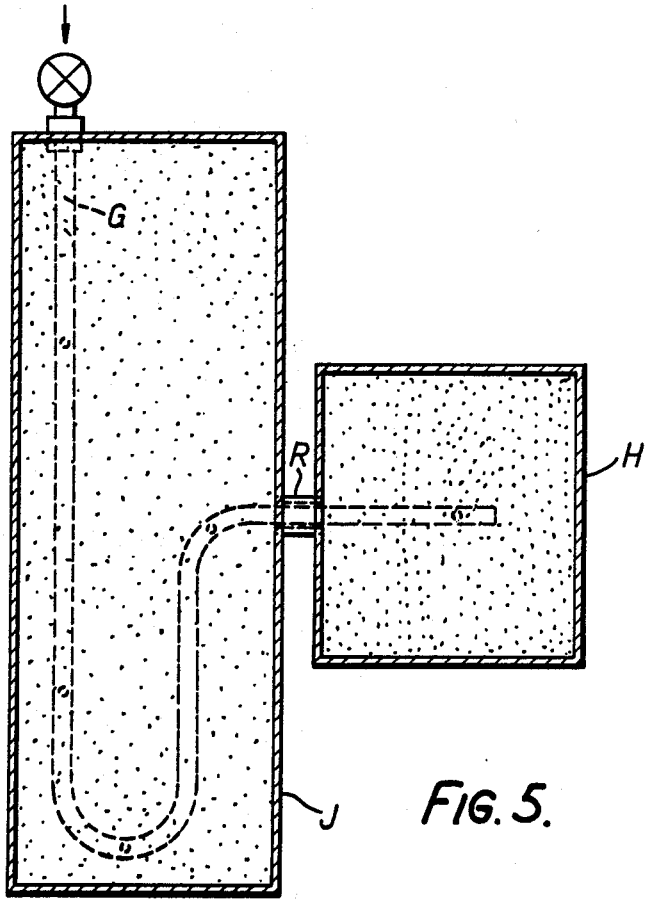

In order that the invention may be more readily understood it will now be described, by way of example only, with reference to the accompanying drawings, in which:

FIG. 1 is a diaggammatic sectional elevation from the front of a gas fired heating appliance in accordance with one embodiment of the invention, FIG. 2 is a plan on the section II—II of FIG. 1, FIG. 3 is a view of the draught tube which is an alternative to that shown in FIGS. 1 and 2, FIG. 4 is a diagrammatic sectional side elevation of a gas fired heating appliance in accordance with a second embodiment of the invention, and FIG. 5 is a plan on the section V—V of FIG. 4.

A gas fired heating appliance as shown in FIGS. 1 and 2 comprises a metal tray C mounted on short legs C' so that there is an air-space beneath the base of the tray. The tray can be of any convenient cross section but preferably it is of rectangular cross section. A tube A is positioned in the tray, extending through a gland in a side wall thereof. The tube is of generally U shape and is secured at a position above the base of the tray. A plurality of openings D are formed in the tube A particularly on the upper side thereof. Apart from the tube A the tray C contains a bed B of particulate refractory material such as sand. Mounted on the upper surface of the sand there are a plurality of bodies E which are of refractory material and which are simulated in colour and shape to represent solid fuel. The bodies are positioned on the surface of the bed and are spaced apart.

A draught tube F passes upwardly through the base of the tray C and extends to the surface of the bed B. The lower end of the tube extends to the air space beneath the base of the tray. The upper end of the tube is positioned between the bodies E. In FIGS. 1 and 2 a single draught tube F is shown but more than one tube may be used dependent on the overall size of the appliance and the effect required and such additional tubes are indicated in FIG. 2 by reference F'.

When the appliance is in use, gas is applied to the tube A and it escapes through the openings D and percolates through the bed B of refractory material. The tube and the bed B serve as a distributor which distributes the gas fairly evenly over the surface of the bed. When the gas is ignited, luminous flames play around the simulated solid fuel E. The air drawn upwardly through the or each draught tube F causes the gas at the vicinity of the upper end of the tube to be burnt at a higher temperature and the flame burning with a higher temperature raises the temperature of the refractory simulated material E to a higher temperature than is the case when the flames of of a luminous character and the impression given is that the simulated material begins to glow.

FIG. 3 shows a draught tube F'' having an enlarged outlet in the form of a fish-tail at its upper end to distribute the air over a larger surface area of the appliance. At its lower end the tube has a valve P which enables the flow of air through the tube to be adjusted.

In the embodiment of the invention shown in FIGS. 4 and 5, the appliance has two metal trays J and H respectively. A gas tube G passes through the tray J and through a gland and spacer R into the tray H. The gland and spacer R helps to secure the tube G in the two trays and also serves to keep the two trays apart so that there is a draught slot M between the two trays. The tube G is closed at its end which is in tray H and numerous holes K are formed in the tube, including some holes in each tray so that gas applied to the tube is distributed through refractory particulate material contained in the two trays. The refractory bodies E which simulate solid fuel are mounted on the upper side of the sand in the two trays and overlap between the two trays but are spaced apart so that air drawn through the slot M can pass between various refractory bodies E.

In use with gas supplied to the pipe G, gas is distributed over the surface of the refractory particulate material in the two trays and burns with a luminous flame except in the vicinity of the slot M where air is drawn up through the gap to the upper side of the distributor to produce higher flame temperatures, a greater brightness, a higher degree of realism and a higher radiant thermal efficiency.

The invention is particularly applicable to simulated coal or coke fires since the air supplied through the or each duct causes the flames to glow in the manner associated with a real coke or coal fire. The refractory bodies however, which are conveniently of ceramic material, can simulate wood logs, ovoids, peat or lignite.

A gas fired heating appliance in accordance with this invention may be used in conjunction with a boiler for heating water. The boiler may be a conventional saddle back boiler or a simple water tube boiler. The tubes of the latter may be set back by a short distance from the fire or they may be buried in the refractory bodies which simulate the solid fuel.

A gas fired heating appliance in accordance with this invention may be used in conjunction with a convector heating applicance. The heating appliance may be positioned within a hollow casing having provision for drawing in cool air at the base and for expelling air heated in the chamber out of the top of the chamber. If desired forced circulation may be provided to allow heated air to be ducted to areas away from the applicance. Furthermore, a controlled part of the heated air may be passed to the or each draught tube of the appliance in order to supply heated air to the heart of the appliance thereby raising the temperature of the glowing simulated solid fuel and hence improving its overall radiant thermal efficiency.

If the appliance is located in the partition wall between two rooms, the fire being accessible to one of the rooms, then air heated by the fire can be ducted to the other room and if desired a back boiler can also be incorporated.

The appliance can be contained within an existing or specially built metal stove having heat resisting transparent windows providing a view of the burning "fuel." These stoves are normally of high efficiency and incorporate boiler and/or air heated convection.

Throughout this specification the expression — heating appliance — means any device capable of radiating heat at any level of thermal efficiency.

I claim:

1. A simulated solid fuel burning heating appliance comprising a mass of particulate refractory material in at least one open-topped tray, a plurality of refractory bodies shaped and colored to simulate solid fuel mounted on the top of the mass of particulate refractory material with spaces between the bodies, a perforated tube embedded in said mass of refractory material with an end of the tube extending out of the tray, means for supplying gaseous fuel to said end of the tube to cause said gaseous fuel to flow upwardly through the mass of particulate refractory material to the spaces between the bodies and burn wth a luminous flame causing the refractory bodies to glow, and tube means defining at least one air passage which extends upwardly through the mass of particulate refractory material for providing combustion air to the gaseous fuel flowing to only some of said spaces between the bodies so that said gaseous fuel provided with combustion air from said passage burns with a higher temperature flame than the temperature of said luminous flame to cause the refractory bodies heated by the higher temperature flame to glow more brightly than the bodies heated by the luminous flame, thereby realistically simulating a solid fuel fire.

2. A heating appliance as claimed in claim 1, in which said tube means comprises at least one tube extending through the particulate material to the surface thereof.

3. A heating appliance as claimed in claim 2, wherein the tube has an enlarged outlet at its upper end.

4. A heating appliance as claimed in claim 2, wherein the tube includes means for adjusting the flow of air therethrough.

5. A heating appliance comprising a mass of particulate refractory material in at least one open-topped tray, a plurality of refractory bodies shaped and colored to simulate solid fuel mounted on the top of the mass of particulate refractory material with spaces between the bodies, a perforated tube embedded in said mass of refractory material with an end of the tube extending out of the tray, means for supplying gaseous fuel to said end of the tube and means for defining at least one air passage which extends upwardly with respect to the mass of particulate refractory material to spaces between said refractory bodies, and wherein said refractory material is contained in two separate horizontally spaced apart trays each having upstanding side walls, adjacent side walls of the two spaced apart trays define said air passage and some of said refractory bodies overlie the upper end of the air passage.

* * * * *